US010345731B2

(12) United States Patent
Horiuchi

(10) Patent No.: US 10,345,731 B2
(45) Date of Patent: Jul. 9, 2019

(54) IMAGE FORMING APPARATUS

(71) Applicant: CANON KABUSHIKI KAISHA, Tokyo (JP)

(72) Inventor: Izuru Horiuchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 15/462,532

(22) Filed: Mar. 17, 2017

(65) Prior Publication Data

US 2017/0277064 A1 Sep. 28, 2017

(30) Foreign Application Priority Data

Mar. 28, 2016 (JP) ..... 2016-064114

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/04036; G03G 15/04072
See application file for complete search history.

(56) References Cited

U.S. PATENT DOCUMENTS 7,170,544 B2 1/2007 Horiuchi ..... 347/247
7,466,454 B2 * 12/2008 Minamino ..... H04N 1/4052 358/3.03
8,917,305 B2 12/2014 Nakahata et al. ..... 347/244
9,261,809 B2 2/2016 Furuta ..... G03G 15/043
2007/0122043 A1 * 5/2007 Hasegawa ..... G06T 3/4007 382/232
2013/0027501 A1 1/2013 Yano ..... B41J 2/435
2016/0147170 A1 5/2016 Furuta ..... G03G 15/04072
2017/0019560 A1 1/2017 Horiuchi et al. ..... H04N 1/113
2017/0019561 A1 1/2017 Furuta ..... H04N 1/4052
(Continued)

FOREIGN PATENT DOCUMENTS

JP 2004-338280 12/2004
JP 2013-022913 2/2013

OTHER PUBLICATIONS

U.S. Appl. No. 15/461,206, filed Mar. 16, 2017.
U.S. Appl. No. 15/466,582, filed Mar. 22, 2017.
U.S. Appl. No. 15/459,951, filed Mar. 15, 2017.

*Primary Examiner* — William J Royer
(74) *Attorney, Agent, or Firm* — Venable LLP

(57) ABSTRACT

An image forming apparatus including: a photosensitive member rotatable in a first direction; an exposure unit configured to scan the photosensitive member with a light beam in a second direction substantially orthogonal to the first direction to form a latent image; a generation unit configured to generate data corresponding to a gradation of a predetermined pixel of input image data by dividing the predetermined pixel by a predetermined division number; a calculation unit configured to calculate an ideal division number depending on a position of the predetermined pixel in the second direction; and a determination unit configured to determine the predetermined division number based on the ideal division number, wherein the determination unit feeds back an error between an ideal division number and a division number for a pixel at a position preceding the predetermined pixel in determining the predetermined division number for the predetermined pixel.

8 Claims, 11 Drawing Sheets

(56) References Cited

U.S. PATENT DOCUMENTS

| | | | | |
|---|---|---|---|---|
| 2017/0019562 | A1 | 1/2017 | Furuta et al. | G03G 15/043 |
| 2017/0019563 | A1 | 1/2017 | Araki | H04N 1/06 |
| 2017/0019564 | A1 | 1/2017 | Horiuchi | H04N 2201/0094 |
| 2017/0038703 | A1 | 2/2017 | Horiuchi et al. | H04N 2201/0094 |
| 2017/0041489 | A1 | 2/2017 | Furuta | H04N 2201/0094 |

* cited by examiner

IMAGE FORMING APPARATUS

BACKGROUND OF THE INVENTION

Field of the Invention

The present invention relates to an image forming apparatus, for example, a digital copying machine, and more particularly, to an image forming apparatus configured to perform magnification correction of an optical system.

Description of the Related Art

In an electrophotographic image forming apparatus, for example, a digital copying machine, an image is formed by forming an electrostatic latent image on a photosensitive member through control of laser in accordance with an image signal, and by performing developing, transfer, and fixing steps. A laser beam radiated to the photosensitive member is deflected with a rotation of a rotary polygon mirror, and the photosensitive member is scanned in a longitudinal direction (hereinafter referred to as "main scanning direction") with the laser beam. Moreover, with the rotation of the photosensitive member, scanning is performed in a direction (hereinafter referred to as "sub-scanning direction") orthogonal to the main scanning direction, and a two-dimensional latent image is formed on the photosensitive member. Moreover, in the deflection with the rotation of the rotary polygon mirror, the laser beam is radiated to the photosensitive member through an fθ lens to perform optical correction with the fθ lens. In other words, scanning characteristics of the laser beam, such as a scanning speed, an optical path length, and an angle of incidence in the longitudinal direction are uniformized by the fθ lens.

When a simple fθ lens is used, a slight residual of the scanning characteristics that remains even after the optical correction by the fθ lens is corrected by magnification correction processing in the main scanning direction through image processing. For example, there is a method involving treating each pixel in units (hereinafter referred to as "divided pixels") obtained by dividing one pixel in the main scanning direction, and converting a gradation of each pixel through pulse width modulation (PWM) (Japanese Patent Application Laid-Open No. 2013-022913). This method is a method of for suppressing a degradation in image quality by subjecting image data that has been converted through PWM to interpolation processing with a high frequency in units of a divided pixel. Positions (hereinafter referred to as "insertion-extraction positions") at which divided pixels are inserted or extracted through the interpolation processing occur substantially at fixed intervals in the main scanning direction for a fixed magnification. In order to prevent moire caused by interference between a period of the insertion-extraction positions of the divided pixels and a PWM period, the insertion-extraction positions are controlled to reduce occurrence of a local difference in density.

Meanwhile, as the optical structure without the fθ lens in pursuit of a low cost, there has been proposed a method of performing magnification correction entirely with electric correction (Japanese Patent Application Laid-Open No. 2004-338280). In such method, the magnification correction is performed by dividing the main scanning direction into predetermined areas, and modulating a clock frequency in accordance with a magnification in each area. A low-cost optical system may be realized with a configuration in which a PWM signal is controlled in magnification with the optical structure without the fθ lens.

However, in the related-art method, there are problems of an increased hardware scale for correction processing and a reduction in image quality. As illustrated in FIG. 8A, in the structure without the fθ lens, a scanning v(θ) with the laser beam is not constant, and depends on an image height, which is a distance from a center in the longitudinal direction of the photosensitive member. Here, θ is an angle of incidence of the laser beam with respect to the photosensitive member. In FIG. 8B, there is shown a magnification at each image height with a magnification at an image height of 0 mm being 1. In order to express the characteristic of the changing magnification as shown in FIG. 8B, for example, a table of magnification information for each pixel may be prepared to address the problem. However, in order to prepare the table of the magnification information, a capacity of a memory for the number of pixels in one line in the main scanning direction is required, and there is a problem of an increased hardware scale.

Moreover, when the gradation is expressed in a digital PWM method, the gradation is quantized in units obtained by dividing a pixel, and hence a quantization error appears as a gradation error. For example, as illustrated in FIG. 8C, with respect to the pixel of part (a) divided by 8, due to the insertion-extraction positions of the divided pixels as indicated by the black circles in parts (b) and (c), the gradation is changed to an increased density in part (b) and to a reduced density in part (c). When the optical system is corrected using the table of the magnification information for each pixel, the same gradation error is arranged at the same position in the main scanning direction, and hence is visually conspicuous. Moreover, even with an fθ lens, which is configured to guide a laser beam deflected by a rotary polygon mirror 204 to a photosensitive drum 102, when an fθ lens having low accuracy is used, similar problems occur.

SUMMARY OF THE INVENTION

The present invention has been made in view of the above-mentioned situation, and therefore has an object to perform magnification correction of a scanning optical system without an fθ lens or with an fθ lens having low accuracy without increasing a hardware scale, to thereby prevent a reduction in image quality caused by a quantization error.

In order to solve the above-mentioned problems, according to one embodiment of the present invention, there is provided an image forming apparatus comprising:

a photosensitive member rotatable in a first direction;

an exposure unit configured to scan the photosensitive member with a light beam in a second direction substantially orthogonal to the first direction to form an electrostatic latent image;

a generation unit configured to generate data corresponding to a gradation of a predetermined pixel of input image data by dividing the predetermined pixel by a predetermined division number;

a calculation unit configured to calculate an ideal division number for the predetermined pixel depending on a position of the predetermined pixel in the second direction; and a determination unit configured to determine the predetermined division number based on the ideal division number calculated by the calculation unit, wherein the determination unit feeds back an error between an ideal division number calculated by the calculation unit and a division number determined by the determination unit for a pixel at a position preceding the predetermined pixel in the second direction in determining the predetermined division number for the predetermined pixel.

Further features of the present invention will become apparent from the following description of exemplary embodiments with reference to the attached drawings.

DESCRIPTION OF THE EMBODIMENTS

Exemplary embodiments of the present invention are illustratively described in detail below with reference to the drawings. A direction of an axis of rotation of a photosensitive drum, which is a direction in which scanning is performed with a laser beam, is defined as a main scanning direction that is a second direction, and a rotational direction of the photosensitive drum, which is a direction substantially orthogonal to the main scanning direction, is defined as a sub-scanning direction that is a first direction.

[Scanning Speed of System without fθ Lens]

Figure 8A:
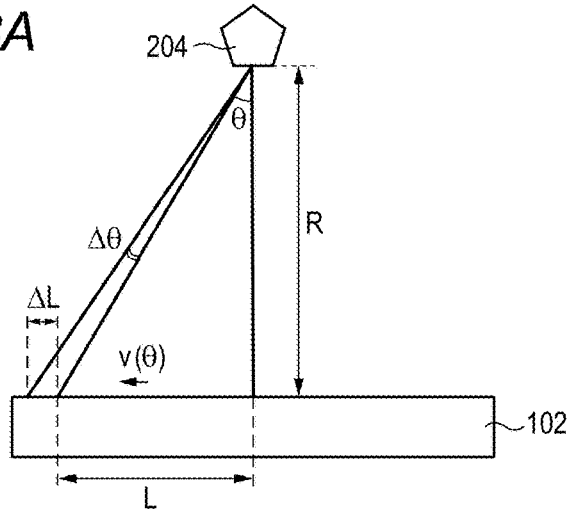
FIG. 8A, FIG. 8B, and FIG. 8C are diagrams for illustrating a light scanning apparatus without an fθ lens according to a related art.

FIG. 8A is a diagram for illustrating a correction amount for the structure without an fθ lens, in other words, the structure in which a photosensitive drum 102 is scanned directly with a laser beam deflected by a rotary polygon mirror 204. An angular velocity of the rotary polygon mirror 204 is represented by ω, and an angle of incidence to the photosensitive drum 102 is represented by θ. Moreover, with an angle of incidence at which a laser beam perpendicularly enters the photosensitive drum 102 being 0°, a distance from the rotary polygon mirror 204 to the photosensitive drum 102 at that time is represented by R. With respect to a position on the photosensitive drum 102 at which the angle of incidence θ is 0, a distance in a scanning direction (hereinafter referred to as "main scanning direction") of the laser beam on the photosensitive drum 102 for an angle of incidence θ is represented by L. When scanning is performed with the laser beam over the distance L in time t, approximate derivation of a scanning speed v(θ) with the laser beam is expressed by the following expressions (1) to (4). Here, a distance by which the laser beam is moved on the photosensitive drum 102 when an angle is changed from the angle of incidence θ by Δθ is represented by ΔL.

$$\Delta L = R \cdot \tan(\theta + \Delta\theta) - R \cdot \tan(\theta) \qquad \text{expression (1)}$$

$$\frac{\Delta L}{\Delta\theta} = R \cdot \frac{\tan(\theta + \Delta\theta) - \tan(\theta)}{\Delta\theta} \qquad \text{expression (2)}$$

$$\Delta\theta \to 0$$

$$\frac{\Delta L}{\Delta\theta} = R \cdot \tan'(\theta) = \frac{R}{\cos^2(\theta)} \qquad \text{expression (3)}$$

$$v(\theta) = \frac{\Delta L}{\Delta t} = \frac{\Delta L}{\Delta\theta} \cdot \frac{\Delta\theta}{\Delta t} = \frac{\Delta L}{\Delta\theta} \cdot \omega = \frac{R\omega}{\cos^2(\theta)} \qquad \text{expression (4)}$$

As illustrated in FIG. 8A, in the system without the fθ lens, the laser beam is obliquely radiated to the photosensitive drum 102 as approaching an end portion of the photosensitive drum 102. Therefore, a scanning speed v(θ) at the end portion of the photosensitive drum 102 is higher than a scanning speed v(θ) at a center portion of the photosensitive drum 102. As a result, widths in the main scanning direction of pixels scanned in the same time are larger at the end portion than at the center portion of the photosensitive drum 102. When stated in terms of a spot shape of the laser beam, the spot shape of the laser beam becomes flatter in the main scanning direction as approaching the end portion of the photosensitive drum 102. Moreover, when stated in terms of a light intensity of the laser beam, the light intensity of the laser beam becomes smaller as approaching the end portion of the photosensitive drum 102.

Figure 8B:
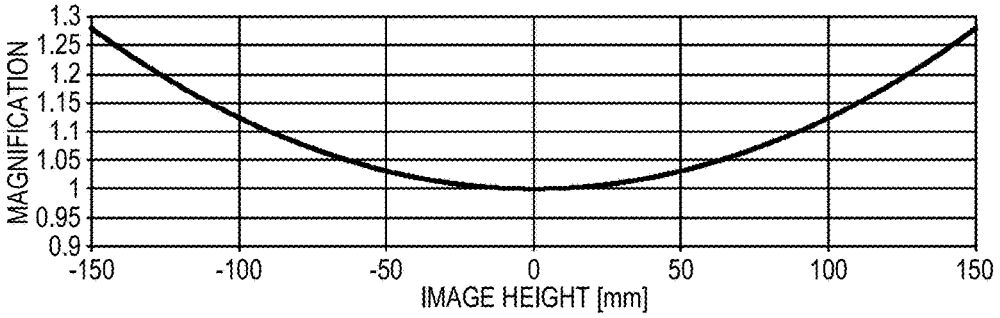

As described above, a magnification of elongation and contraction in the main scanning direction of one pixel is proportional to the scanning speed v(θ). FIG. 8B is a graph obtained by plotting the angle of incidence θ as a distance (hereinafter the term "image height" is also sometimes used) from the center in a longitudinal direction of the photosensitive drum 102 with respect to a predetermined distance R. In FIG. 8B, the horizontal axis indicates the image height with the center in the main scanning direction of the photosensitive drum 102 being 0 mm, and the vertical axis indicates the magnification. The magnification is 1.0 when the image height is 0 mm. The magnification is increased toward both ends of the photosensitive drum 102, and takes a value near 1.3 at the end portion, for example. In order to express a changing characteristic of the magnification as in FIG. 8B, for example, a table of magnification information for each pixel may be prepared to address the problem. However, in order to prepare the table of the magnification information for each pixel, a memory having a capacity of the number of pixels in one line in the main scanning direction is required, and there is a problem of an increased hardware scale.

[Continuity of Gradation Errors in Sub-Scanning Direction]

Figure 8C:
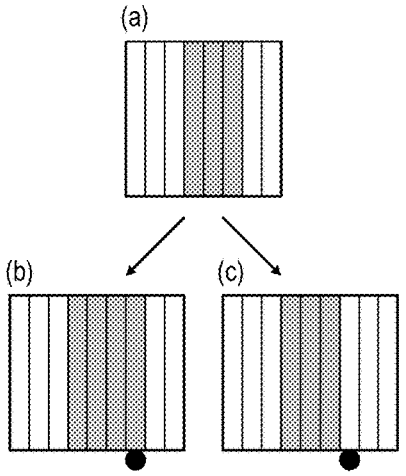

When a gradation is expressed in a digital PWM method, the gradation is quantized in units obtained by dividing a pixel, and hence a quantization error appears as a gradation error. FIG. 8C is a diagram for illustrating the gradation error. In part (a) of FIG. 8C, there is illustrated an example in which a pixel is divided when the gradation is expressed in a PWM method, and units obtained by dividing one pixel are hereinafter referred to as "divided pixels". In part (a) of FIG. 8C, there is illustrated an example in which one pixel is divided by 8, of which three divided pixels are white, the following three divided pixels are black, and the following two divided pixels are white. To such reference (times 8/8) gradation, a black divided pixel is inserted at a position indicated by the black circle in part (b), or a white divided pixel is inserted at a position indicated by the black circle in part (c) so that one pixel is formed by nine divided pixels, to thereby change the magnification (times 9/8). With the magnification being changed as described above, the gradation is changed to an increased density in part (b) of FIG. 8C and to a reduced density in part (c) of FIG. 8C. When an optical system is corrected using the table of the magnification information for each pixel, the same gradation error is arranged at the same position in the main scanning direction, and hence is visually conspicuous.

First Embodiment

[Overall Configuration of Image Forming Apparatus]

Figure 1A:
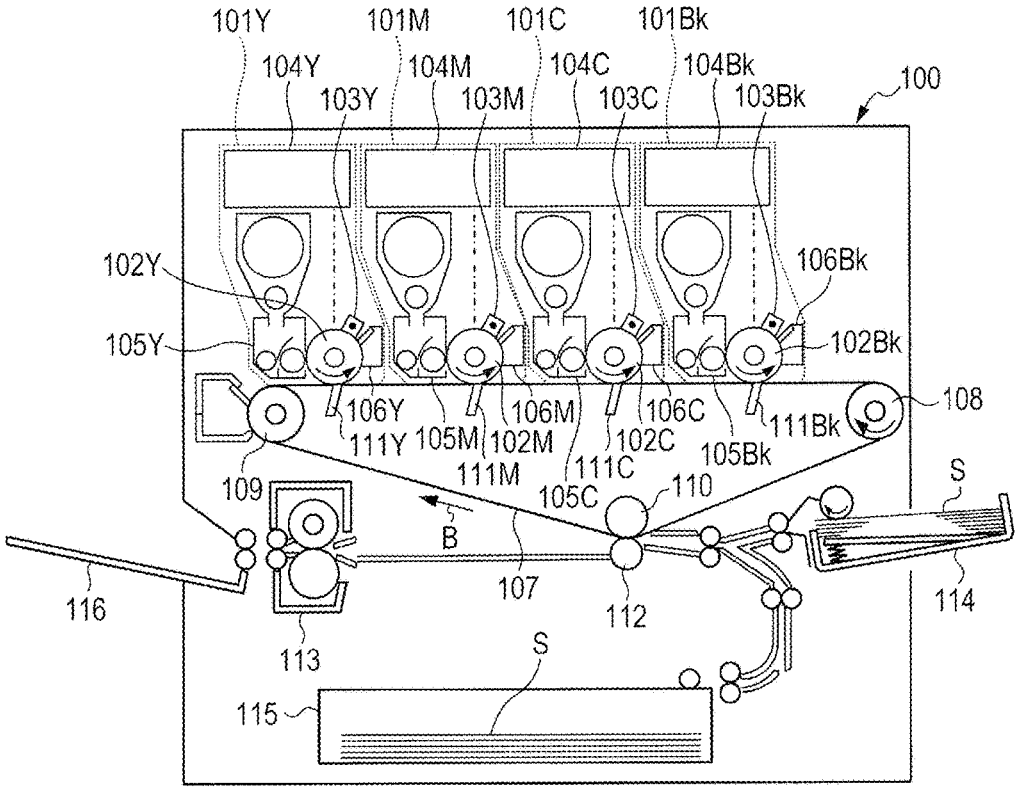
FIG. 1A is a view for illustrating the entirety of an image forming apparatus according to first and second embodiments.

FIG. 1A is a schematic cross-sectional view of a digital full-color printer (color image forming apparatus) configured to perform image formation by using toners of a plurality of colors. An image forming apparatus 100 according to a first embodiment of the present invention will be described with reference to FIG. 1A. The image forming apparatus 100 includes four image forming portions (image forming units) 101Y, 101M, 101C, and 101Bk (broken line portions) respectively configured to form images of different colors. The image forming portions 101Y, 101M, 101C, and 101Bk perform image formation by using toners of yellow, magenta, cyan, and black, respectively. Reference symbols Y, M, C, and Bk denote yellow, magenta, cyan, and black, respectively, and suffixes Y, M, C, and Bk are omitted in the description below unless a particular color is described.

The image forming portions 101 each include a photosensitive drum 102, which is a photosensitive member. A charging device 103, a light scanning device 104, which is an exposure unit, and a developing device 105 are arranged around each of the photosensitive drums 102. A cleaning device 106 is further arranged around each of the photosensitive drums 102. An intermediate transfer belt 107 of an endless belt type is arranged under the photosensitive drums 102. The intermediate transfer belt 107 is stretched around a drive roller 108 and driven rollers 109 and 110, and rotates in a direction of an arrow B (clockwise direction) illustrated in FIG. 1A while forming an image. Further, primary transfer devices 111 are arranged at positions opposed to the photosensitive drums 102 across the intermediate transfer belt 107 (intermediate transfer member). The image forming apparatus 100 according to the embodiment further includes a secondary transfer device 112 configured to transfer a toner image on the intermediate transfer belt 107 onto a sheet S being a recording medium and a fixing device 113 configured to fix the toner image on the sheet S.

An image forming process from a charging step to a developing step of the image forming apparatus 100 will be described. The image forming process is the same in each of the image forming portions 101, and hence the image forming process will be described with reference to an example of the image forming portion 101Y. Accordingly, descriptions of the image forming processes in the image forming portions 101M, 101C, and 101Bk are omitted. The charging device 103Y of the image forming portion 101Y charges the photosensitive drum 102Y that is driven to rotate in the arrow direction (counterclockwise direction) illustrated in FIG. 1A. The charged photosensitive drum 102Y is exposed by a laser beam emitted from the light scanning device 104Y, which is indicated by the dashed dotted line. With this operation, an electrostatic latent image is formed on the rotating photosensitive drum 102Y. The electrostatic latent image formed on the photosensitive drum 102Y is developed by the developing device 105Y to form a toner image of yellow. The same step is performed also in the image forming portions 101M, 101C, and 101Bk.

The image forming process from a transfer step will be described. The primary transfer devices 111 applied with a transfer voltage transfer toner images of yellow, magenta, cyan, and black formed on the photosensitive drums 102 of the image forming portions 101 onto the intermediate transfer belt 107. With this, the toner images of respective colors are superimposed one on another on the intermediate transfer belt 107. That is, the toner images of four colors are transferred onto the intermediate transfer belt 107 (primary transfer). The toner images of four colors transferred onto the intermediate transfer belt 107 are transferred onto the sheet S conveyed from a manual feed cassette 114 or a sheet feed cassette 115 to a secondary transfer portion by the secondary transfer device 112 (secondary transfer). Then, the unfixed toner images on the sheet S are heated and fixed onto the sheet S by the fixing device 113, to thereby form a full-color image on the sheet S. The sheet S having the image formed thereon is delivered to a delivery portion 116.

[Photosensitive Drum and Light Scanning Device]

Figure 1B:
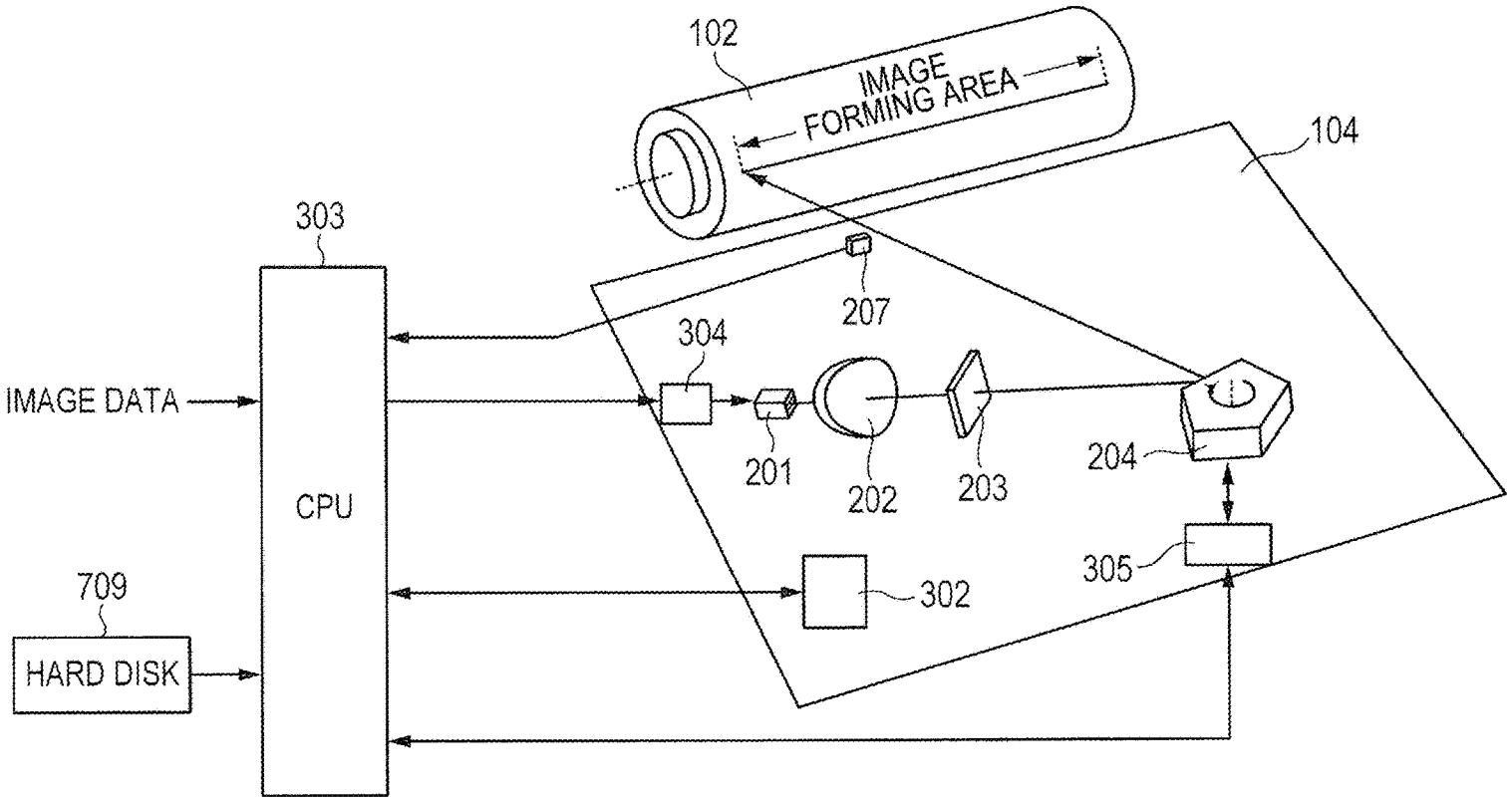
FIG. 1B is a view for illustrating a configuration of the periphery of a photosensitive drum and a light scanning apparatus.

FIG. 1B is an illustration of configurations of the photosensitive drum 102, the light scanning device 104, and a controller for the light scanning device 104. The light scanning device 104 includes a multi-beam laser light source (hereinafter referred to as "laser light source") 201, a collimator lens 202, a cylindrical lens 203, and a rotary polygon mirror 204, which is a deflection unit. The laser light source 201 is a laser light source, which is configured to emit a plurality of laser beams (light beams) from a plurality of light emitting elements (light emitting points). The collimator lens 202 is configured to collimate the laser beam. The cylindrical lens 203 condenses the laser beam having passed through the collimator lens 202 in the sub-scanning direction. In the embodiment, the laser light source 201 is described by exemplifying a light source in which a plurality of light emitting elements are arranged, but is similarly operated also in the case of using a light source having a single light emitting element. The laser light source 201 is driven by a multi-beam laser drive circuit (hereinafter simply referred to as "drive portion") 304. The rotary polygon mirror 204 is formed of a motor portion configured to rotate and a plurality of reflection mirrors mounted on a motor shaft. In the embodiment, the number of the reflection mirrors of the rotary polygon mirror 204 is five (five faces), but the present invention is not limited to this number. A face of the reflection mirror of the rotary polygon mirror 204 is hereinafter referred to as "mirror face". The rotary polygon mirror 204 is driven by a rotary polygon mirror drive portion (hereinafter referred to as "drive portion") 305. The light scanning apparatus 104 also includes a memory 302, which is a storage unit having various kinds of information stored therein.

Further, the light scanning device 104 includes a beam detector 207 (hereinafter referred to as "BD 207"), which is a signal generating unit configured to detect the laser beam deflected by the rotary polygon mirror 204 and output a horizontal synchronizing signal (hereinafter referred to as "BD signal") in accordance with the detection of the laser beam. The laser beam emitted from the light scanning device 104 scans the photosensitive drum 102. The light scanning device 104 and the photosensitive drum 102 are positioned so that the laser beam scans the photosensitive drum 102 in a direction substantially parallel to the rotary shaft of the photosensitive drum 102. Every time the mirror face of the rotary polygon mirror 204 scans the photosensitive drum 102, a spot of the light beam of the multi-beam laser is caused to scan in the main scanning direction, to thereby form scanning lines corresponding to the number of light emitting elements simultaneously.

Next, the controller (CPU 303) for the light scanning apparatus 104 will be described. To the CPU 303, image data is input from a controller (not shown), which generates the image data, and the BD 207, the memory 302, the drive portion 304, and the drive portion 305 are electrically connected to the CPU 303.

[Control of Rotary Polygon Mirror]

The CPU 303 detects a writing start position of a scanning line based on the BD signal output from the BD 207, and counts a time interval of the BD signal. In this manner, the CPU 303 detects a rotation speed of the rotary polygon mirror 204, and instructs the drive portion 305 to accelerate or decelerate so that the rotary polygon mirror 204 reaches a predetermined rotation speed. The drive portion 305 supplies a driving current to the motor portion of the rotary polygon mirror 204 in accordance with an input acceleration or deceleration signal, to thereby drive a motor.

[Control of Image Data]

Figure 2A:
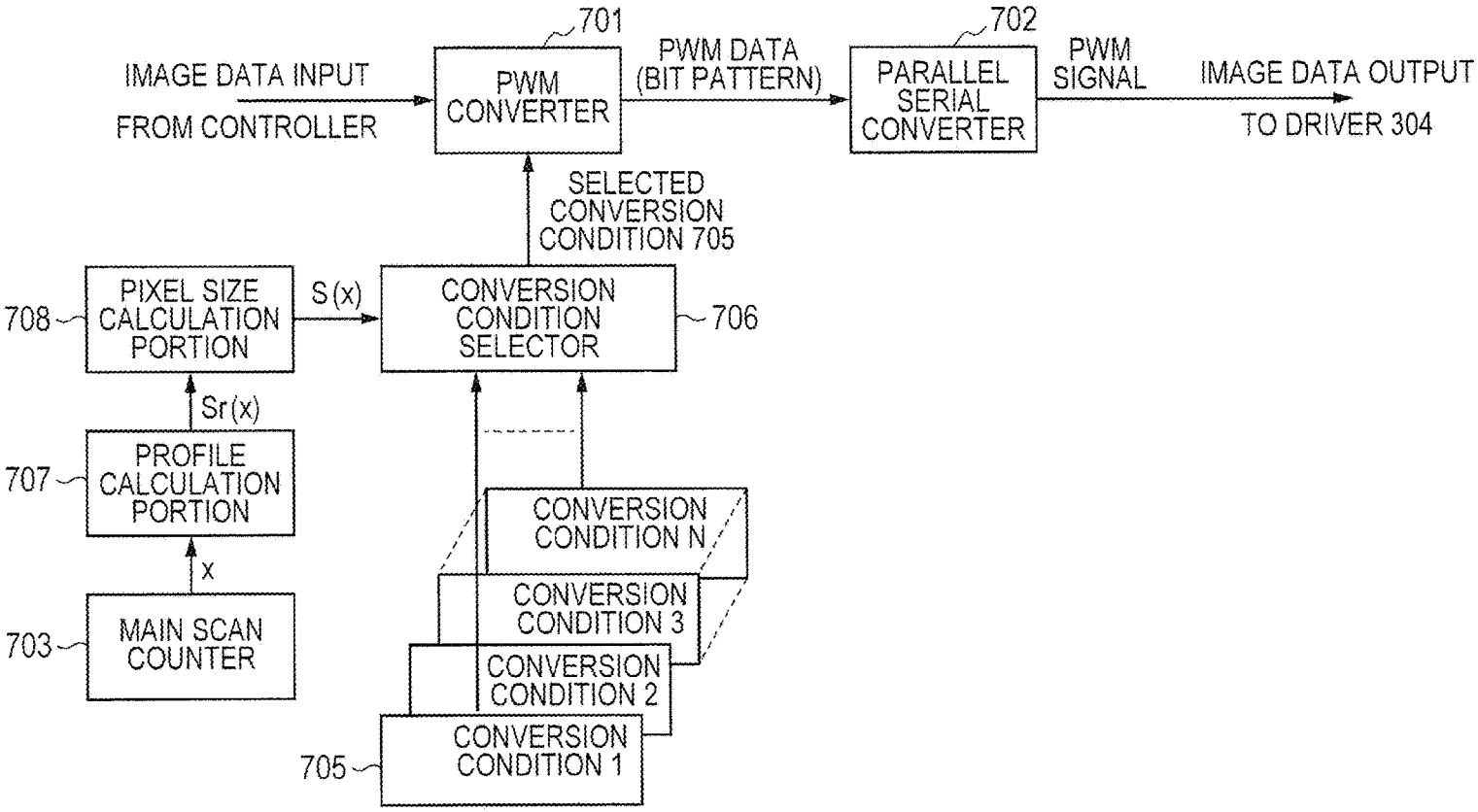
FIG. 2A is a diagram for illustrating image processing in the first embodiment.

Moreover, the CPU 303 converts the image data, which is input from the controller (not shown), into a PWM signal. The image data is a multi-level bit pattern (for example, gradation data of 4 bits or more) indicating a density of each pixel. The gradation data (bit pattern) is converted into PWM data. The PWM signal is generated based on the PWM data obtained as a result of the conversion. The PWM signal is a bit pattern including a plurality of bit data items obtained by converting the gradation data based on a conversion condition, for example, a conversion table of each of Table 1 and Table 2, which are to be described later. FIG. 2A is a block diagram for illustrating a flow in generating the PWM signal based on the gradation data by the CPU 303. The gradation data input from the controller is converted into the PWM data (see part (b) of FIG. 2D) by a PWM converter 701, which is a generation unit, and the PWM data is output to a parallel serial converter 702. Then, the PWM data is serially output by the parallel serial converter 702, and hence is output as the PWM signal (see part (a) of FIG. 2D) to the drive portion 304.

A main scan counter 703, which is reset for each BD signal output from the BD 207, is configured to count a position (x) in the main scanning direction for each pixel to output a count value to a profile calculation portion 707. The profile calculation portion 707, which is a calculation unit, is configured to perform the following calculation to output a calculated value to a pixel size calculation portion 708. Specifically, the profile calculation portion 707 is configured to calculate, for a position (hereinafter referred to as "main scanning position") x in the main scanning direction indicated by the count value of the main scan counter 703, an ideal value Sr(x) of a pixel size, which is an ideal division number, in accordance with a preset function (expression (5) to be described below) to output the calculated ideal value Sr(x) to the pixel size calculation portion 708. In the embodiment, with a pixel size at a time when a division number of one pixel is 24 being set to 1, which is an ideal value of a reference pixel size, the ideal value Sr(x) of the pixel size is determined. In other words, in the embodiment, the ideal value Sr(x) of the pixel size takes a value between 1 (=24/24) and 1.33 . . . (=32/24). Sr(x) is expressed by a quadratic equation of the expression (5) provided below. It should be noted, however, that in the embodiment, 7,200 pixels are included in one line in the main scanning direction, with the center being 3,600.

$$Sr(x)=a\cdot x^2+bx+c \qquad \text{expression (5)}$$

provided that $$\left(a=\frac{24-23}{24}\cdot\frac{1}{3600^2},\ b=-2a\cdot 3600,\ c=1\right)$$

The pixel size calculation portion 708, which is a determination unit, is configured to perform the following calculation to output a calculated value to a conversion condition selector 706. Specifically, the pixel size calculation portion 708 outputs, to the conversion condition selector 706, a pixel size S(x), which is determined by calculation by means of feedback control to be described later, depending on the ideal value Sr(x) of the pixel size input from the profile calculation portion 707. In the embodiment, the pixel size S(x) includes a plurality of pixel sizes S(x) of from 24 to 32, to which a plurality of conversion conditions 1 to N (N=9) (hereinafter also referred to as "conversion conditions 705") corresponding to the plurality of pixel sizes S(x) are made to correspond. For example, the conversion condition 1 is made to correspond to a case where a pixel size S(x), which is a division number of one pixel, is 24, and the conversion condition 2 is made to correspond to a case where a pixel size S(x) is 25. Thereafter, the conversion condition obtained by adding one to the number of the conversion condition is made to correspond to the pixel size S(x) every time one is added to the pixel size S(x). The conversion conditions 705 will be described later.

The conversion condition selector 706, which is a selection unit, outputs, to the PWM converter 701, the conversion condition 705 selected from among the conversion conditions 1 to N depending on the pixel size S(x)=24 to 32, which has been input from the pixel size calculation portion 708. The PWM converter 701 outputs, to the parallel serial converter 702, the bit pattern (PWM data of FIG. 2D), which is data corresponding to the gradation, in accordance with the conversion condition 705 (table) selected for each pixel by the conversion condition selector 706 depending on the gradation of each pixel. The bit pattern is data expressed by 0s and 1s, for example. The parallel serial converter 702 serially outputs the bit data items included in the bit pattern, which is input from the PWM converter 701, one bit at a time in accordance with a clock signal. In this manner, the bit data items are converted into a serial signal, and the serial signal is output as the PWM signal to the drive portion 304. In the embodiment, information on the conversion conditions 705 is stored in a hard disk 709. The CPU 303 performs control so that the conversion conditions 705 read from the hard disk 709 when activated are copied to the memory 302 to enable high-speed processing by accessing the memory 302 during image processing.

[Conversion Condition]

The conversion condition 705 in the embodiment is a profile for converting gradation data of one pixel into the PWM data, and the profile may be realized as a table or a function, for example. The conversion condition 705 is defined for each pixel size. In Table 1, there is shown a conversion condition for a case where the pixel size S(x) is 32. In Table 2, there is shown a conversion condition for a case where the pixel size S(x) is 24. In the embodiment, there is adopted a configuration in which the conversion conditions 705 include the conversion condition 1 to the conversion condition 9 corresponding to the pixel size S(x)=24 to the pixel size S(x)=32, respectively, but the present invention is not limited to this value.

TABLE 1

| Input | B |
|---|---|
| 0 | 0 |
| 1 | 3 |
| 2 | 6 |
| 3 | 8 |
| 4 | 10 |
| 5 | 12 |
| 6 | 14 |
| 7 | 16 |
| 8 | 18 |
| 9 | 20 |
| 10 | 22 |
| 11 | 24 |
| 12 | 26 |
| 13 | 28 |
| 14 | 30 |
| 15 | 32 |

TABLE 2

| Input | B |
|---|---|
| 0 | 0 |
| 1 | 3 |
| 2 | 5 |
| 3 | 6 |
| 4 | 8 |
| 5 | 9 |
| 6 | 11 |
| 7 | 12 |
| 8 | 14 |
| 9 | 15 |
| 10 | 17 |
| 11 | 18 |
| 12 | 20 |
| 13 | 21 |
| 14 | 23 |
| 15 | 24 |

In Table 1 and Table 2, the left column indicates the gradation data of one pixel, and "B" in the right column indicates a length (width) of the divided pixels expressed as black with each unit obtained by dividing one pixel corresponding to the gradation data in the left column by a predetermined division number being one unit (hereinafter referred to as "divided pixel"), and indicates an ON state width of the PWM signal. The length (width) of the divided pixels, which are expressed as black in one pixel when one pixel is divided by the predetermined division number, is hereinafter referred to as "length (width) of black", and when divided pixels are expressed as white, a length of the divided pixels is similarly referred to as "length of white". When the PWM data is expressed as follows: white→black→white, a length of the first white is represented by W, a length of black is represented by B, and a length of white after black is represented by W'. When the pixel size (division number) is represented by S, B is a length shown in Table 1 and Table 2, W is expressed as: W=INT((S−B)/2), and W' is determined so that W'=S−B−W. Here, INT( ) is a function that returns an integer part of an argument. For example, when the pixel size S(x) is 24 (S=24), and when the input gradation data is 6 (bit pattern; '0110'), the PWM converter 701 sets the length of black B to 11 (B=11) based on Table 2. Then, the length of white before black W is obtained as: W=INT((24−11)/2)=INT(6.5)=6, and the length of white after black W' is obtained as: W'=(24−11−6)=7. In other words, the PWM converter 701 converts the bit pattern: '0110' into '000000111111111110000000' based on Table 2.

Figure 2B:
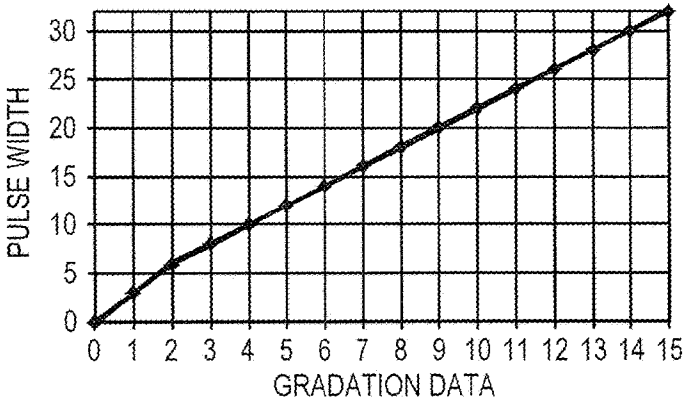
FIG. 2B and FIG. 2C are graphs for showing an input gradation and a pulse width.
Figure 2C:
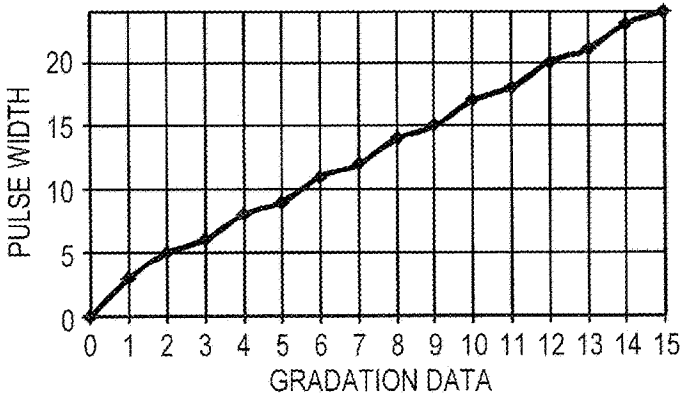

FIG. 2B is a graph obtained by expressing the conversion condition in Table 1 (pixel size S(x)=32 (32 divisions)) with the gradation data and a pulse width (length of black B). FIG. 2C is a graph obtained by expressing the conversion condition in Table 2 (pixel size S(x)=24 (24 divisions)) with the gradation data and the pulse width (length of black B). The horizontal axis indicates the gradation data (4 bits, 16 gradations), and the vertical axis indicates the pulse width (that is, length of black B) of the PWM signal. In the embodiment, setting is made so that the conversion condition is approximated even with a different division number. In the embodiment, there is described an example of obtaining the PWM signal in which the black region grows from the center of the pixel (hereinafter referred to as "center-growing PWM signal"). However, for example, a PWM signal in which the black region grows from the head of the pixel ("left-growing PWM signal") may be obtained. In the left-growing PWM signal, when the ON state width of the PWM signal is black and an OFF width thereof is white, and when a length of black is represented by B, a length of white is represented by W, and the pixel size is represented by S, the length of white W may be determined from the expression: W=S−B. Moreover, the present invention is equally applicable to a pattern in which the black region grows from the tail of the pixel, and to a pattern in which the black region grows from both ends toward the center of the pixel. Moreover, information containing not only the width of the black region (ON state width of the PWM signal), but also supplementary information, for example, a position in a pixel, as one set may be treated as the conversion condition, and the present invention is equally applicable to such case.

[Relationship between Conversion Condition and PWM Data]

An example in which the pixel size and data on W, B, and W' determined from the conversion condition 705 are output as the PWM data will be described below. For example, when continuous pixels have the pixel sizes S(x)=32, 24, and 24, and the gradation data=10 (bit pattern: '1010'), 1 (bit pattern: '0001'), and 5 (bit pattern: '0101'), the processing is performed as follows. The conversion condition selector 706 selects the conversion condition 9 (Table 1) corresponding to the pixel size S(x)=32, the conversion condition 1 (Table 2 ) corresponding to the pixel size S(x)=24, and the conversion condition 1 corresponding to the pixel size S(x)=24 in the stated order. The conversion condition selector 706 outputs the selected conversion condition 9, conversion condition 1, and conversion condition 1 to the PWM converter 701. The PWM converter 701 determines, in accordance with the conversion condition 705 input from the conversion condition selector 706, B based on Table 1 and Table 2, and W and W' based on the above-mentioned expressions, and outputs the PWM data for generating the PWM signal to the parallel serial converter 702.

Figure 2D:
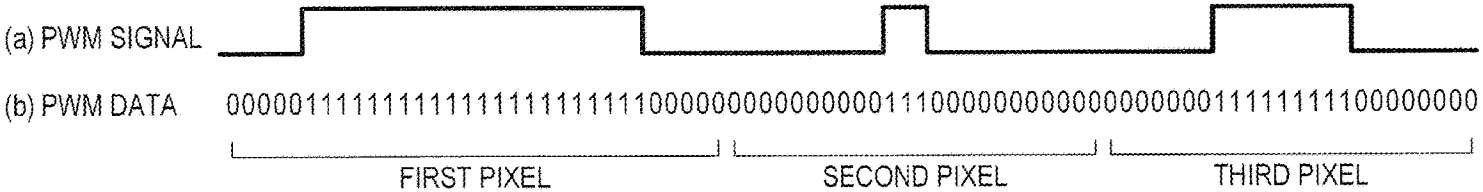
FIG. 2D is a diagram for illustrating PWM data and a PWM signal.

FIG. 2D is a diagram for illustrating a correspondence between the PWM data (bit pattern), in which white is expressed as 0 and black is expressed as 1, and the PWM signal. In part (b) of FIG. 2D, the PWM data output from the PWM converter 701 to the parallel serial converter 702 is illustrated. In part (a) of FIG. 2D, the PWM signal output by the parallel serial converter 702 by converting the PWM data into a serial sequence with 1 being a high level and 0 being a low level is illustrated. For example, the first pixel has the pixel size S(x) of 32 and the gradation data of 10 (bit pattern: '1010'). The PWM converter 701 determines that W=5 and W'=5 using B=22 corresponding to the gradation data 10 of Table 1, and outputs the PWM data formed of 0s and is corresponding to W, B, and W'. W, B, and W' are similarly determined for the second pixel and the third pixel, and a description thereof is omitted.

[Flow of Page Processing]

Figure 3A:
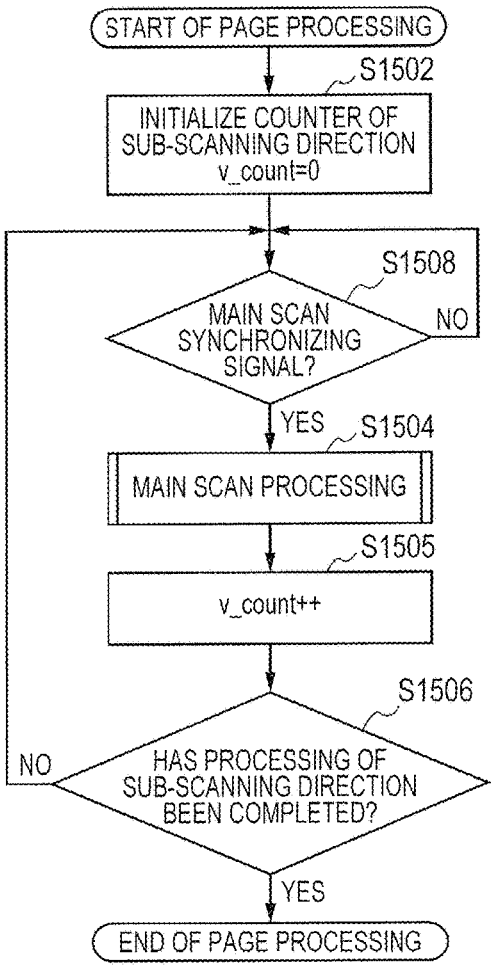
FIG. 3A is a flowchart for illustrating page processing in the first embodiment.
Figure 3B:
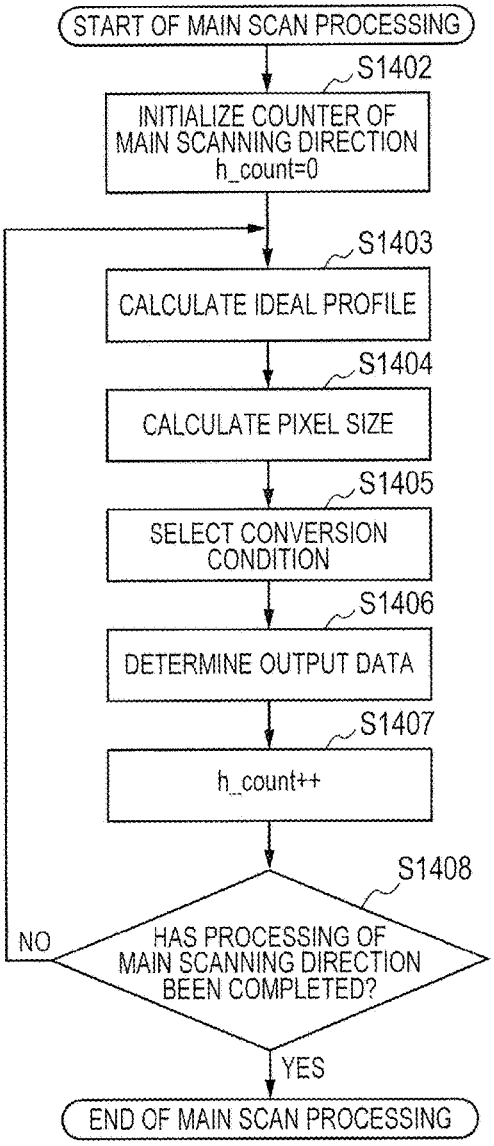
FIG. 3B is a flowchart for illustrating main scan processing.

Regarding page processing of the embodiment, processing of a sub-scanning direction will be described with reference to FIG. 3A, and processing of the main scanning direction will be described with reference to FIG. 3B. First, the processing of the sub-scanning direction of FIG. 3A will be described. When the page processing is started, in Step (hereinafter abbreviated as "S") 1502, the CPU 303 initializes a counter of the sub-scanning direction v_count (v_count=0). In S1508, the CPU 303 determines whether or not a main scan synchronizing signal, which is generated as a low active (negative logic) signal, has been output in synchronization with the BD signal output from the BD 207. When the CPU 303 determines in S1508 that the main scan synchronizing signal has not been output, the processing returns to S1508. When the CPU 303 determines in S1508 that the main scan synchronizing signal has been output, the processing proceeds to S1504. In S1504, the CPU 303 executes main scan processing for one line. Details of the main scan processing in S1504 are described later with reference to FIG. 3B. In S1505, the CPU 303 increments the counter of the sub-scanning direction v_count (v_count++). In S1506, the CPU 303 refers to the counter of the sub-scanning direction v_count to determine whether or not a counter value has reached a predetermined value, that is, whether or not the processing of the sub-scanning direction for one page has been completed. When the CPU 303 determines in S1506 that the processing of the sub-scanning direction has not been completed, the processing returns to S1508. When the CPU 303 determines in S1506 that the processing of the sub-scanning direction has been completed, the page processing is ended.

[Processing of Main Scanning Direction]

Operation of the processing of the main scanning direction in S1504 of FIG. 3A will be described with reference to FIG. 3B. When the processing of the main scanning direction in S1504 of FIG. 3A is started, in S1402, the CPU 303 initializes a counter of the main scanning direction h_count (h_count=0). In S1403, the CPU 303 causes the profile calculation portion 707 to calculate the ideal value Sr(x) (in FIG. 3B, illustrated as "ideal profile") of the pixel size. As described above, the ideal value Sr(x) of the pixel size at a main scanning position x indicated by the counter of the main scanning direction h_count is expressed as the expression (5). For example, when the counter of the main scanning direction h_count is 1,400, an ideal value Sr(1,400) is about 1.21 based on the expression (5), and when the counter of the main scanning direction h_count is 1,800, an ideal value Sr(1,800) is 1.25.

In S1404, the CPU 303 causes the pixel size calculation portion 708 to calculate the pixel size S(x). Processing of calculating the pixel size S(x) will be described later. In S1405, the CPU 303 causes the conversion condition selector 706 to select the conversion condition 705 corresponding to the pixel size S(x) input from the pixel size calculation portion 708. For example, when 24 is input as the pixel size S(x), the conversion condition selector 706 selects the conversion condition 1. In S1406, the CPU 303 causes, in accordance with the conversion condition selected by the conversion condition selector 706, the PWM converter 701 to convert the input gradation data into the PWM data described above with reference to FIG. 2D, and to output the PWM data to the parallel serial converter 702. The parallel serial converter 702 converts the input PWM data into the PWM signal to determine output data. The CPU 303 outputs the PWM signal, which is obtained as a result of the conversion in the PWM converter 701, to the drive portion 304.

In S1407, the CPU 303 increments the counter of the main scanning direction h_count (h_count++). In S1408, the CPU 303 determines whether or not the counter of the main scanning direction h_count has reached a predetermined value, that is, whether or not the processing of the main scanning direction for one line has been completed. When the CPU 303 determines in S1408 that the processing of the main scanning direction has not been completed, the processing returns to S1403. When the CPU 303 determines in S1408 that the processing of the main scanning direction has been completed, the processing of the main scanning direction is ended, and the processing proceeds to S1505 of FIG. 3A.

[Processing of Determining Pixel Size S(x)]

Figure 4:
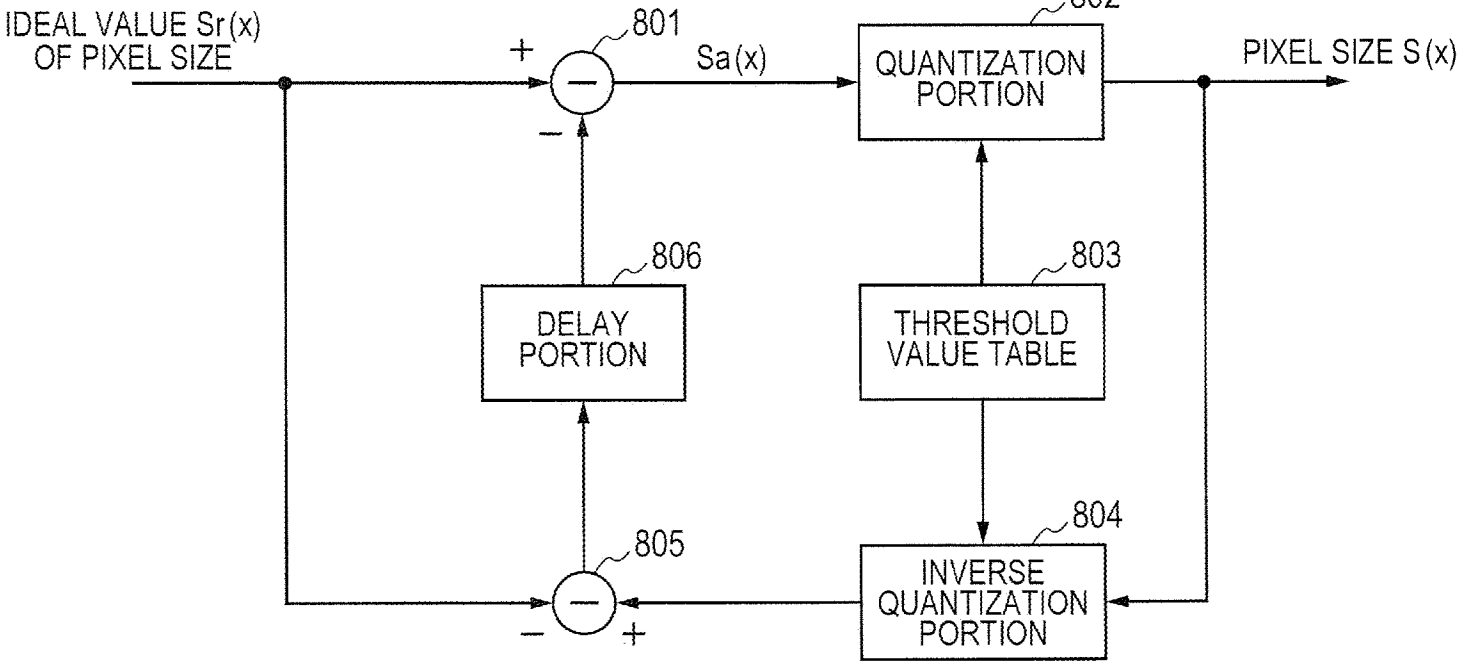
FIG. 4 is a block diagram for illustrating processing performed by a pixel size calculation portion in the first embodiment.

Next, operation of the pixel size calculation portion 708 in S1404 of FIG. 3B will be described with reference to FIG. 4. When Sr(x), which is the ideal value of the pixel size as a target for each pixel and expressed as the expression (5), is input, the pixel size calculation portion 708 operates as follows. The pixel size calculation portion 708 outputs, to a quantization portion 802, a value Sa(x) obtained by subtracting a quantization error, which is carried from a pixel at a preceding position in the main scanning direction, and is an output from a delay portion 806 to be described later, from the ideal value Sr(x) by a subtractor 801. Here, a main scanning position of a current pixel is represented by x, and a main scanning position of a previous pixel (preceding pixel in the main scanning direction) is represented by x−1. The quantization portion 802 determines n that satisfies a condition of the following expression (6), and outputs the determined n as the pixel size S(x).

$$\left(n-\frac{1}{2}\right)\cdot\frac{1}{D_{base}} \le S_a(x) < \left(n+\frac{1}{2}\right)\cdot\frac{1}{D_{base}} \qquad \text{expression (6)}$$

(n is an integer)

A threshold value table 803 outputs a threshold value used in the expression (6) to the quantization portion 802 and an inverse quantization portion 804, which is to be described later, based on a reference division number Dbase. To the inverse quantization portion 804, the pixel size S(x) is also input from the quantization portion 802. For example, in the embodiment, the reference division number Dbase is set as follows: Dbase=24. The inverse quantization portion 804 multiplies the pixel size S(x), which is input from the quantization portion 802, by a threshold value 1/Dbase (=1/24), which is input from the threshold value table 803, to be inverse quantized (S(x)×1/Dbase), and outputs the result to a subtractor 805. Here, while the ideal value Sr(x) of the pixel size takes a value of 1 when the pixel size S(x) is 24, the pixel size S is a division number (for example, 24) of one pixel, and is different in scale. Therefore, it can be said that the inverse quantization portion 804 performs processing of matching the scales.

The subtractor 805 subtracts, from the value (S(x)×1/Dbase) input from the inverse quantization portion 804, the ideal value Sr(x) of the pixel size ((S(x)×1/Dbase)−Sr(x)), and outputs an error component in the quantization (quantization error) to the delay portion 806. The delay portion 806 feeds back the quantization error to an ideal value Sr(x+1) of the next pixel size with a delay of one pixel through the subtractor 801. While the above-mentioned feedback processing is repeated, the pixel size calculation portion 708 outputs, to the conversion condition selector 706, the pixel size S(x) as an integer corresponding to the division number of the pixel. In the embodiment, a quantization error of the first pixel in the main scanning direction in one line is 0. Moreover, in the embodiment, the quantization error of the preceding pixel is fed back for each pixel, but there may be adopted a configuration in which the quantization error is fed back every two or three pixels. Further, there may be adopted a configuration in which the feedback is performed every random number of pixels in one line.

Figure 5A:
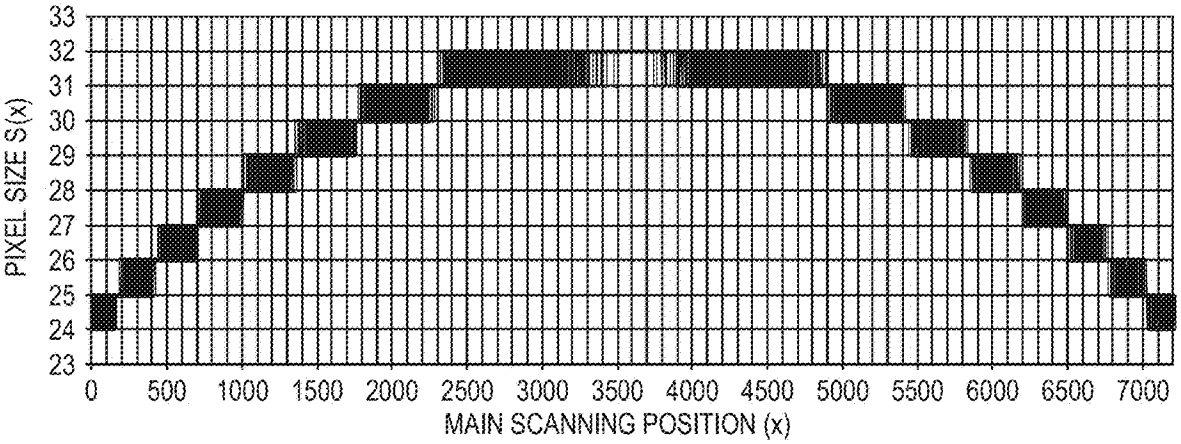
FIG. 5A and FIG. 5B are graphs for showing main scanning positions and a change in pixel size in the first embodiment.

The entire output result in the main scanning direction of the pixel size calculation portion 708 is shown in FIG. 5A. In FIG. 5A, the horizontal axis indicates the main scanning position (x), and the vertical axis indicates the pixel size S(x) output by the pixel size calculation portion 708 to correspond to each main scanning position x. As shown in FIG. 5A, it can be seen that, with divisions at both end portions in the main scanning direction and 32 divisions at the center portion, two kinds of pixel sizes are alternated in each portion through the feedback control. In other words, at both end portions in the main scanning direction, any one of the pixel size S(x)=24 and the pixel size S(x)=25 is selected, to thereby perform control so that an average value of the pixel sizes is the ideal value Sr(x) of the pixel size in a predetermined pixel range.

Figure 5B:
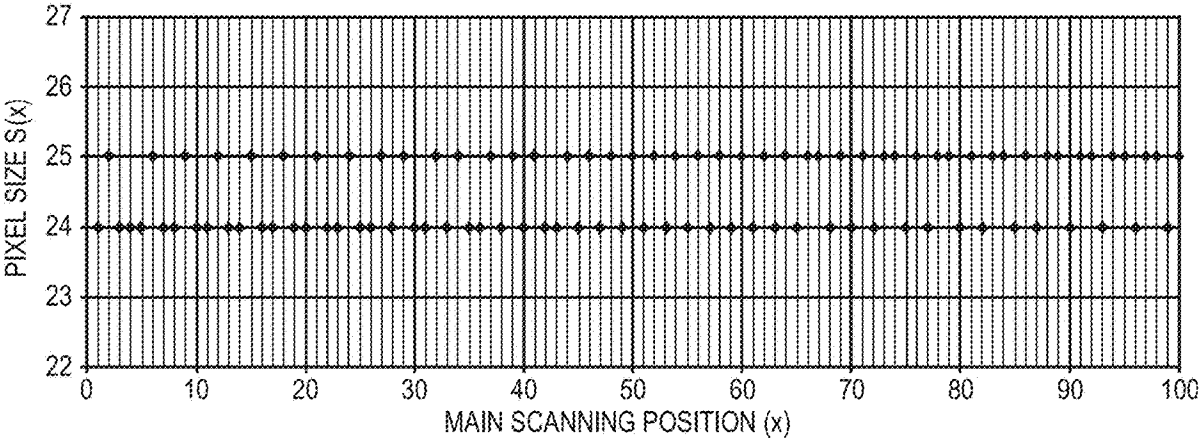

In addition, a change in the output of the pixel size S(x), which is output from the pixel size calculation portion 708 to correspond to pixels on the head side, that is, the 0th pixel to the 100th pixel in the main scanning direction, is shown in FIG. 5B. As shown in FIG. 5B, it can be seen that, for the pixels at position 0 to position 100 in the main scanning direction, the pixel size S(x) alternates between 24 and 25. Further, it can be seen that, as the main scanning position x of the pixel becomes larger, the frequency of outputting the pixel size S(x)=25 becomes higher, in other words, the frequency of outputting the pixel size S(x)=24 becomes lower, and that the pixel size S(x) transitions from 24 to 25. Through the above-mentioned control on the pixel size, the target value Sr(x) and the quantized data may be compared in the subtractor 805 to calculate the quantization error. Then, the previous quantization errors are incorporated in the subtractor 801 when a pixel size S(x) of the next pixel is calculated so that a plurality of pixels reach the target pixel size.

In the embodiment, the pixel size S(x) is calculated through automatic calculation based on a profile of ideal magnification information (ideal value Sr(x) of the pixel size), with the result that a capacity of the memory for storing the profile information may be minimized, and that the increase in hardware scale is suppressed. In the embodiment, only a capacity of the memory for storing the coefficients a, b, and c of the quadratic curve of the expression (5), which expresses the profile, is required, and a significant effect is provided.

As described above, according to the embodiment, magnification correction of a scanning optical system without the fθ lens or with an fθ lens having low accuracy is performed without increasing the hardware scale, with the result that the reduction in image quality caused by the quantization error can be prevented.

Second Embodiment

[Operation of Pixel Size Calculation Portion]

Figure 6:
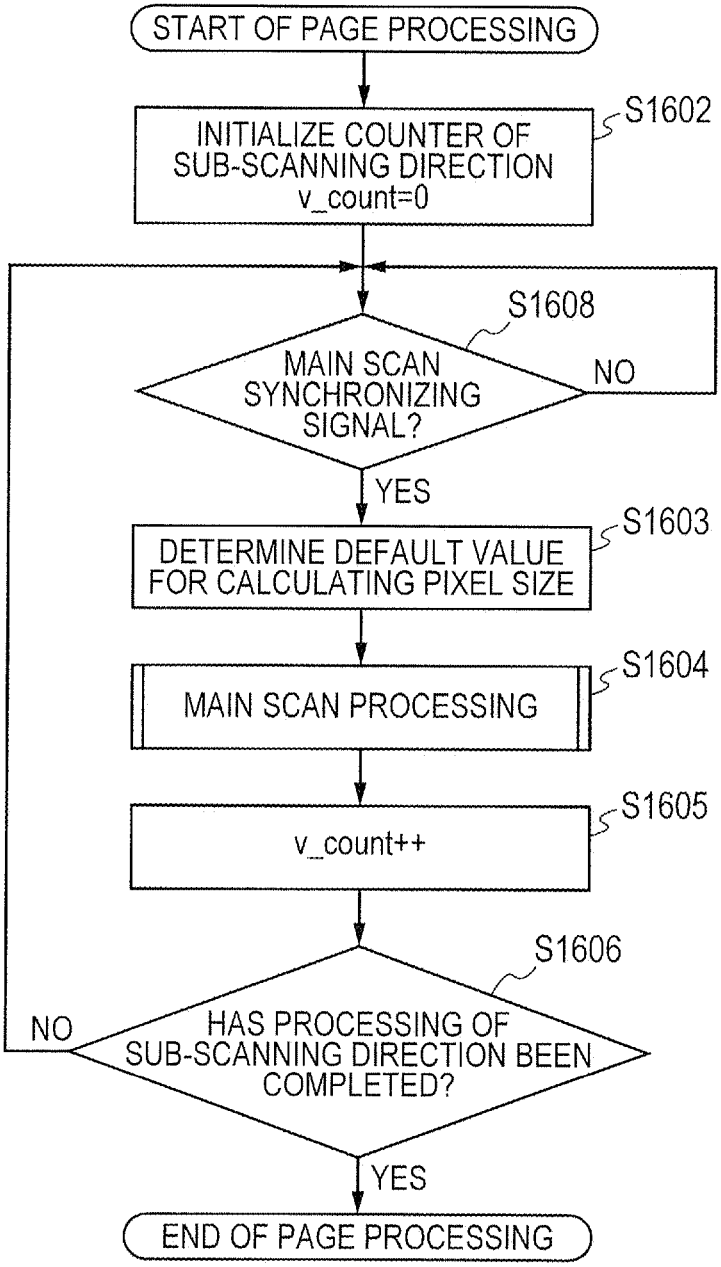
FIG. 6 is a flowchart for illustrating page processing in the second embodiment.

A second embodiment of the present invention is similar to the first embodiment in basic configuration, and is different in operation of the pixel size calculation portion 708. Components like those described in the first embodiment are denoted by like reference symbols, and a description thereof is omitted. The operation of the pixel size calculation portion 708 in the embodiment will be described with reference to a flowchart of the sub-scanning direction of FIG. 6. Processing in S1602 and S1608 of FIG. 6 is the same as the processing in S1502 and S1508 of FIG. 3A, and hence a description thereof is omitted. In the embodiment, prior to the processing of the main scanning direction in S1604, the CPU 303 determines in S1603 an internal parameter for use in calculating the pixel size, that is, a default value in calculating the pixel size S(x). Processing in S1604 to S1606 is similar to the processing in S1504 to S1506 of FIG. 3A, and hence a description thereof is omitted.

Figure 7A:
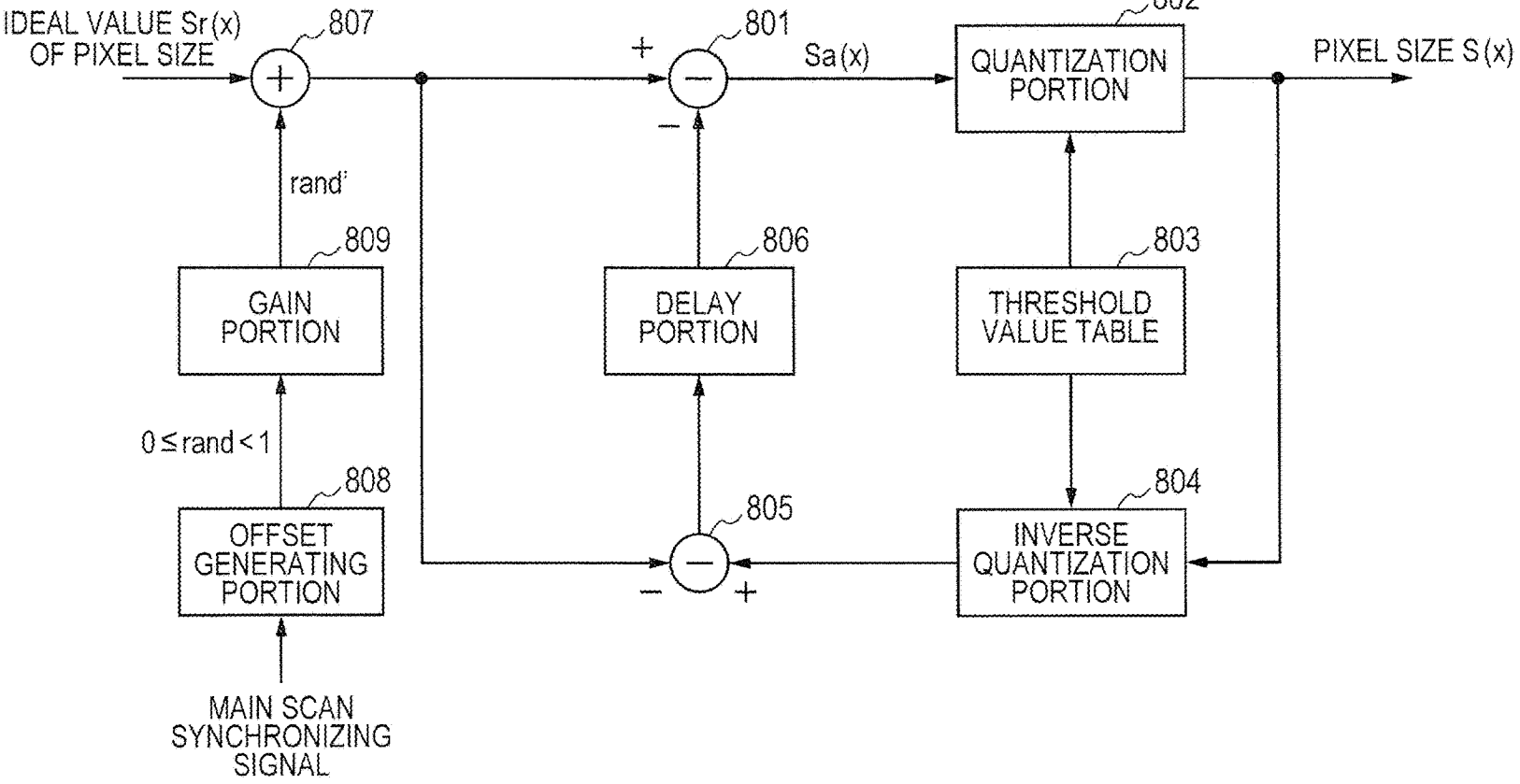
FIG. 7A is a block diagram for illustrating processing performed by a pixel size calculation portion in the second embodiment.

The processing of the pixel size calculation portion 708 in the embodiment will be described with reference to FIG. 7A. When the ideal value Sr(x) of the pixel size as a target for each pixel is input, the pixel size calculation portion 708 determines the default value for use in the calculation of the pixel size, which has been described in S1603 of FIG. 6, at a timing when the main scan synchronizing signal is input. The pixel size calculation portion 708 causes an offset generating portion 808 to output a random number rand (0≤rand<1) to a gain portion 809. The gain portion 809 multiplies the random number rand, which is input from the offset generating portion 808, by the above-mentioned 1/Dbase so that rand' (=rand×1/Dbase) falls in a range corresponding to one divided pixel, and outputs rand' to an adder 807. This operation sets rand' to a value that is less than one divided pixel. The adder 807 adds rand' to the ideal value Sr(x) (value with the reference value being 1) of the target pixel size (Sr(x)+rand'), and outputs the result to the subtractor 801 and the subtractor 805. In this manner, according to the embodiment, for the first pixel in the main scanning direction in one line, rand', which is an offset that is less than one divided pixel (less than one unit), is added to the ideal value Sr(x) of the pixel size.

The subtractor 801 outputs, to the quantization portion 802, a value Sa(x) obtained by subtracting the quantization error, which has been carried from the previous pixel, from the value input from the adder 807. Operations of the quantization portion 802, the threshold value table 803, and the inverse quantization portion 804 are similar to those in the first embodiment. The subtractor 805 is configured to subtract the value input from the adder 807 from the value input from the inverse quantization portion 804 to output the quantization error component to the delay portion 806. The delay portion 806 feeds back the quantization error component to the next output from the adder 807 with a delay of one pixel through the subtractor 801. While the above-mentioned feedback processing is repeated, the pixel size calculation portion 708 outputs the pixel size S(x) as an integer corresponding to the division number of the pixel.

[Timing when Offset is Output]

Figure 7B:
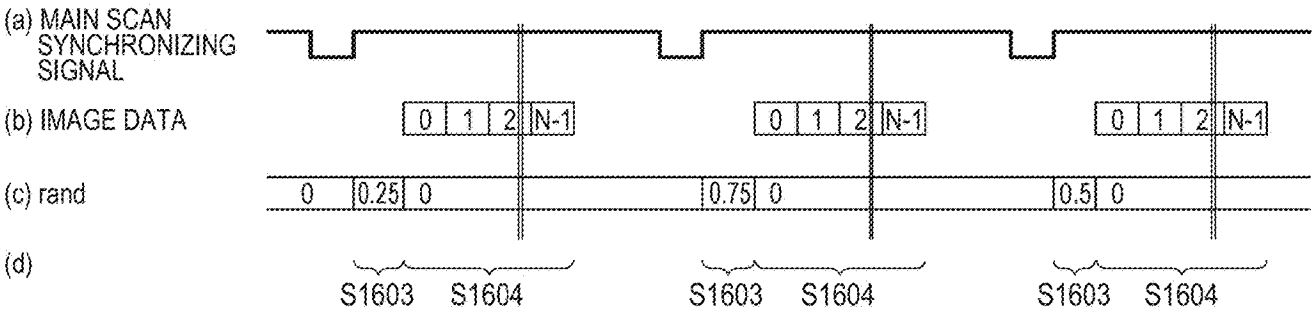
FIG. 7B is a timing chart for illustrating generation of random numbers.

Operation of the offset generating portion 808 will be described with reference to a timing chart of FIG. 7B in relation to the step numbers of FIG. 6. In part (a) of FIG. 7B, the main scan synchronizing signal is illustrated, and in part (b) of FIG. 7B, the gradation data is illustrated. In part (c) of FIG. 7B, the random number rand output from the offset generating portion 808 is illustrated, and in part (d) of FIG. 7B, the step numbers of the flowchart illustrated in FIG. 6 are illustrated. When the main scan synchronizing signal is input (part (a) of FIG. 7B), the offset generating portion 808 generates the random number rand (S1603 in part (d) of FIG. 7B). The offset generating portion 808 outputs 0 at the other timings. In other words, rand' is added to Sr(x) only for the first pixel in the main scanning direction in one line, and 0 is added to Sr(x) for the subsequent pixels. Then, on each piece of the gradation data, the processing of the main scanning direction is executed (S1604 in part (d) of FIG. 7B). When the main scan processing in one line is completed, and the counter of the sub-scanning direction v_count is incremented to proceed to the next line, the offset generating portion 808 generates a new random number rand. In part (c) of FIG. 7B, rand is a random number, and hence a different value (0.25, 0.75, 0.5, . . . ) is illustrated to be generated for each line. In the embodiment, an offset (rand') that is less than one divided pixel is added to the ideal value Sr(x) of the pixel size of the first pixel in one line, with the result that the main scanning position x at which the pixel size S(x) is changed may be shifted for each line.

Figure 7C:
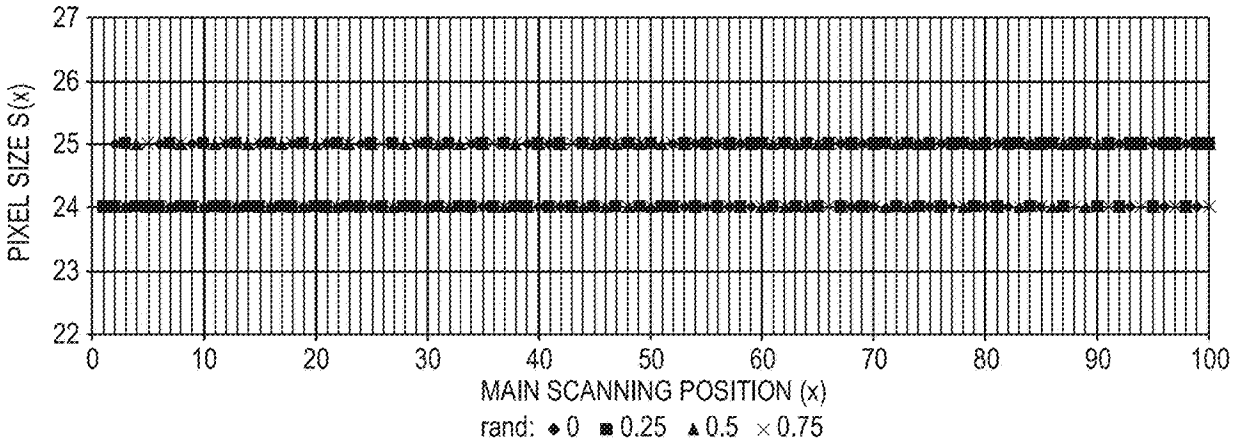
FIG. 7C is a graph for showing main scanning positions and a change in pixel size in the second embodiment.

Of the entire output result in the main scanning direction of the pixel size calculation portion 708 in the embodiment, a change in the output of the pixel size on the head side is shown in FIG. 7C. FIG. 7C is a graph similar to FIG. 5B. In FIG. 7C, S(x) for a case where rand=0 is plotted with rhombus symbols (♦), and S(x) for a case where rand=0.25 is plotted with square symbols (■). Further, S(x) for a case where rand=0.5 is plotted with triangle symbols (▲), and S(x) for a case where rand=0.75 is plotted with cross symbols (×). In the embodiment, positions at which the pixel size S(x) is changed may be varied with a difference in default value for calculating the pixel size to prevent the pixel size S(x) from being changed at the same main scanning position in each line, to thereby reduce moire. In addition, the offset generating portion 808 only adds the offset corresponding to a value that is less than one divided pixel, and hence a moving average of the pixel sizes S(x) among pixels that are close to each other generally falls in a deviation range corresponding to one divided pixel even when rand is different. As the random number in the embodiment, a pseudo-random number is generated by a linear feedback shift register (LFSR). However, another method may be used, and for example, a sufficient number of registers may be selected in order cyclically to generate a pseudo-random number.

According to the embodiment, a minimum random number is added to the default value for calculating the pixel size to reduce the frequency of overlapping positions of change in the sub-scanning direction of the pixel size S(x) at the same main scanning position in each line, to thereby prevent the degradation in image quality, for example, moire, with the result that magnification correction with high image quality is achieved. In the above-mentioned embodiments, the magnification correction is performed with reference to the ideal value Sr(x) of the pixel size of the profile calculation portion 707. However, a plurality of corrections may be easily performed by including magnification correction for other factors, such as contraction of an image due to contraction of paper in a fixing process of electrophotography, to be combined in the profile. Moreover, in the above-mentioned embodiments, the maximum division number of one pixel is 32, but the present invention may be embodied even with a higher division number enabled by digital control by means of a delay-locked loop (DLL) and other such technologies.

Moreover, in the above-mentioned embodiments, the conversion condition is made to correspond to the pulse width of the PWM signal (or PWM pattern), but may be associated with another parameter indicating the gradation of the pixel. For example, in a case of an image forming apparatus in which a gradation of a pixel is associated with a laser emission intensity, there is a problem of a varying accumulated light intensity depending on a difference in pixel size. According to the present invention, characteristic of associating the gradation with the emission intensity may be switched for each pixel size to control the gradation of each pixel, with the result that satisfactory conversion conditions may be obtained as the entire image.

As described above, according to the embodiment, magnification correction of the scanning optical system without the fθ lens or with the fθ lens having low accuracy is performed without increasing the hardware scale, with the result that the reduction in image quality caused by the quantization error can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-064114, filed Mar. 28, 2016, which is hereby incorporated by reference herein in its entirety.

What is claimed is:

1. An image forming apparatus, comprising:

a photosensitive member rotatable in a first direction;

an exposure unit configured to scan the photosensitive member with a light beam in a second direction substantially orthogonal to the first direction to form an electrostatic latent image;

a generation unit configured to generate data corresponding to a gradation of a predetermined pixel of input image data by dividing the predetermined pixel by a predetermined division number;

a calculation unit configured to calculate an ideal division number for the predetermined pixel depending on a position of the predetermined pixel in the second direction; and a determination unit configured to determine the predetermined division number based on the ideal division number calculated by the calculation unit, wherein the determination unit feeds back an error between an ideal division number calculated by the calculation unit and a division number determined by the determination unit for a pixel at a position preceding the predetermined pixel in the second direction in determining the predetermined division number for the predetermined pixel.

2. An image forming apparatus according to claim 1, further comprising:

information on a plurality of conversion conditions respectively corresponding to a plurality of division numbers; and a selection unit configured to select information on a predetermined conversion condition from among the plurality of conversion conditions depending on the predetermined division number determined by the determination unit, wherein the generation unit generates the data corresponding to the gradation of the predetermined pixel using the information on the predetermined conversion condition selected by the selection unit.

3. An image forming apparatus according to claim 2, wherein the exposure unit comprises:

a light source configured to emit a light beam; and a drive portion configured to drive the light source, wherein the data corresponding to the gradation comprises a bit pattern for generating a PWM signal for driving the drive portion, and wherein the information on the predetermined conversion condition comprises information making the gradation correspond to a pulse width of the PWM signal.

4. An image forming apparatus according to claim 2, wherein the determination unit adds, in determining a division number for a first pixel in the second direction, to an ideal division number calculated for the first pixel by the calculation unit, an offset less than one unit, the offset being obtained by dividing a pixel by a reference division number.

5. An image forming apparatus according to claim 4, wherein the determination unit determines the offset using a random number.

6. An image forming apparatus according to claim 3, wherein the exposure unit comprises a deflection unit configured to deflect the light beam emitted from the light source, and wherein the light beam deflected by the deflection unit intactly scans on the photosensitive member.

7. An image forming apparatus according to claim 3, wherein the exposure unit comprises:

a deflection unit configured to deflect the light beam emitted from the light source; and an fθ lens configured to perform optical correction of the light beam deflected by the deflection unit to guide the light beam to the photosensitive member.

8. An image forming apparatus, comprising:

a photosensitive member;

a light source configured to emit a light beam according to a drive signal;

a deflection unit configured to deflect the light beam so that the light beam scans on the photosensitive member; and a controller configured to control the light source, the controller including, a first converter configured to convert an image data indicating a density to a bit pattern including a plurality of bit data, a setting unit configured to set to the first converter a number of bit data included in the bit pattern depending on a position of a pixel in a scanning direction of the light beam, and a second converter configured to generate the drive signal by outputting the bit pattern converted by the first converter bit by bit in synchronization with a clock signal, wherein the setting unit sets to the first converter a plurality of conversion conditions including a first conversion condition for converting the image data to the bit pattern of a first number of bits and a second conversion condition for converting the image data to the bit pattern of a second number of bits, and wherein the setting unit sets one of the first conversion condition and the second conversion condition to each pixel included in one region which is included in a plurality of regions divided in the scanning direction and which includes a plurality of pixels so that a pixel generated under the first conversion condition and a pixel generated under the second conversion condition are mixed in the one region.

* * * * *